US005755438A

United States Patent [19]

Deminski

[11] Patent Number: 5,755,438

[45] Date of Patent: May 26, 1998

[54] HOCKEY SPHERE GAME

[76] Inventor: Kerry J. Deminski, 369 Green St., Nanticoke, Pa. 18634

[21] Appl. No.: 856,352

[22] Filed: May 14, 1997

[51] Int. Cl.[6] ..... A63B 67/00

[52] U.S. Cl. ..... 273/109; 273/113; 273/118 R; 273/123 R; 273/440; 273/458; 273/461; 273/459

[58] Field of Search ..... 273/108, 109, 273/113, 118 R, 123 R, 457, 458, 459, 461, 440, 453, DIG. 14; 473/594, 615

[56] References Cited

U.S. PATENT DOCUMENTS

| | | | |
|---|---|---|---|
| 2,301,506 | 11/1942 | Bean | 273/DIG. 14 X |
| 3,423,872 | 1/1969 | Dodson | 273/109 X |
| 3,806,123 | 4/1974 | Fennell | 273/109 |
| 4,595,369 | 6/1986 | Downs | 273/109 X |
| 4,756,530 | 7/1988 | Karman | 273/113 |
| 4,848,773 | 7/1989 | Lovik | 273/458 X |
| 5,348,307 | 9/1994 | Duggan | 273/320 |

*Primary Examiner*—Raleigh W. Chiu
*Attorney, Agent, or Firm*—Richard L. Huff

[57] ABSTRACT

A game device played with rules similar to a hockey game. Te device contains an inflated transparent sphere containing a plurality of handles, nets between the handles, and a ball on the inside of the sphere. The object is to roll or bounce the ball into the opponent's goal. The game may be played between individuals or teams.

2 Claims, 2 Drawing Sheets

HOCKEY SPHERE GAME

BACKGROUND OF THE INVENTION

1. Field of the invention

This invention relates to an apparatus for playing a hockey sphere game and a method for using the apparatus.

2. Description of the related art

The most closely related prior art known of by the inventor is the paddle game apparatus disclosed in U.S. Pat. No. 5,348,307. The game apparatus of the prior invention includes two paddles held parallel to each other and a resilient ball held between them. Each paddle has an aperture and an associated net which serves as a goal. The object of the prior art game is to roll the ball between the two paddles so that it goes into the opponent's goal. A disadvantage of the prior art game is its lack of three-dimensional action as the ball should always be secured between the paddles. Another disadvantage of the prior art apparatus is the possibility of the ball inadvertently falling from between the paddles. Another disadvantage is the possibility of one player avoiding being scored upon by retracting the paddle so as to allow the ball to fall from between the paddles, thus stopping play. Also, the prior art apparatus allows for only two players at any one time.

SUMMARY OF THE INVENTION

The present invention overcomes the above disadvantages by providing an inflated sphere which contains an inner surface, an outer surface and a circumscribed space within the sphere. There is a scoring ball within the sphere and a plurality of pairs of handles attached to the outer surface of the sphere. Each pair of handles has an associated goal which is an airtight extended sac. The sacs are sized so that they can easily admit the scoring ball. The apparatus will allow the game to be played by two to four players. Since the ball is continually contained within the sphere, there is no possibility of the ball inadvertently leaving the field of play. Also, a player who is about to be scored upon cannot stop the game by having the ball leave the area of play. The present invention will be further described in the accompanying drawing which form a part of the description and wherein like numbers refer to like parts in the several figures.

DESCRIPTION OF THE PREFERRED EMBODIMENTS

Figure 1:
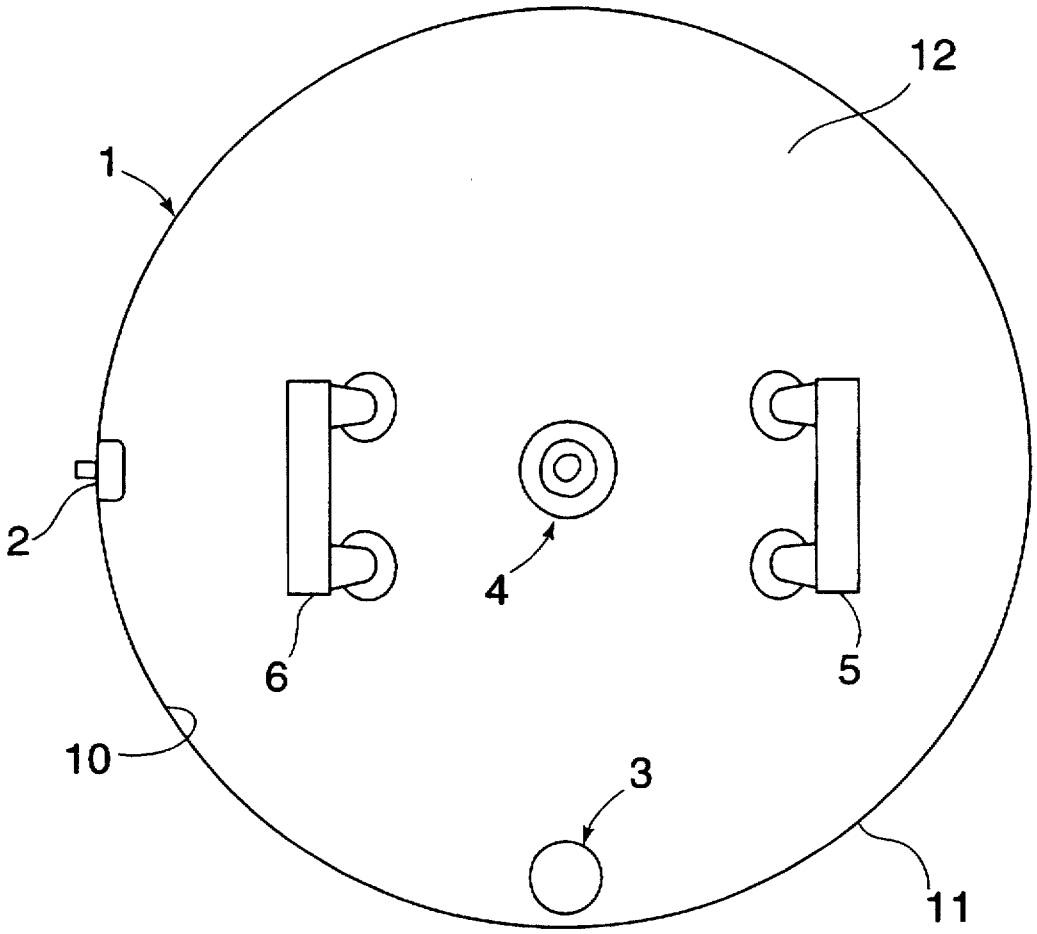
FIG. 1 is a side elevational view of the game apparatus of the present invention.
Figure 2:
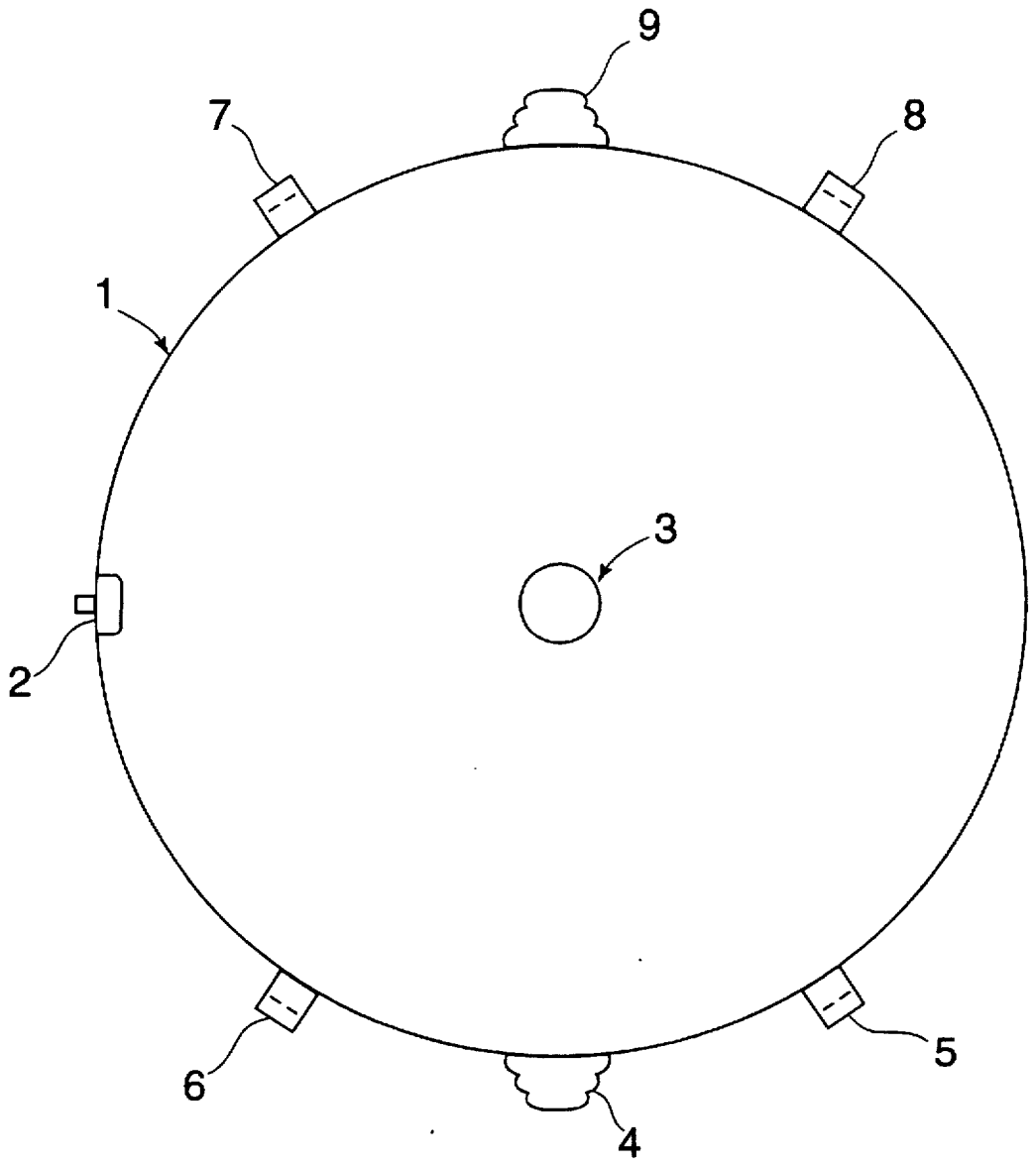
FIG. 2 is a top plan view of the game apparatus.

The apparatus of the present invention comprises an inflated transparent sphere 1. For this purpose, there may be use any of a variety of suitable strong, resilient polymers which are commercially available. Sphere 1 contains an inner surface 10, an outer surface 11, and a circumscribed space 12.

The sphere 1 contains an inflating tab 2 so that the game apparatus may be compactly stored when it is not in use. Also, deflating the apparatus while it is not in use avoids undue tension on the polymeric material, and leads to longer life of the apparatus. Tab 2 allows fast, easy inflation of the sphere 1 allowing for a short preparation time.

Sphere 1 contains a scoring ball 3. This ball may be made of sponge rubber, air-filled rubber, or plastic, and should be of such construction that no harm would come to a player should the player's face be in contact with the sphere 1 when the ball 3 impacts the sphere 1.

The sphere 1 contains a plurality of accordion-pleated sacs 4, 9 which serve as goals. For optimum use, there should be from two to four such sacs 4, 9, each sac 4, 9 being of such size to easily admit the scoring ball 3. preferably, a sac 4, 9 will have a diameter of about twice the diameter of the scoring ball 3. The sacs 4, 9 are conveniently made of the same material used for making the remainder of the sphere 1.

On either side of each sac 4, 9 there is a handle 5, 6, 7, 8. There are two handles 5, 6, 7, 8 for each player. The handles 5, 6, 7, 8 are attached to the outer surface 11 of the sphere 1 by welding or gluing.

The object of the game is to maneuver the handles 5, 6, 7, 8 so as to roll or bounce the ball 3 into an opponent's sac 4, 9. This requires strength, eye-hand coordination, and quick reflexes, and so is useful in developing these characteristics. The rules are flexible. the winner may be the player with the most scores in a set time, or the player to first reach a set number of scores. When there are four players, each player may play as an individual or two players may form a team. The apparatus 1 is light enough so that a single player could practice alone.

I claim:

1. A device for playing a hockey sphere game, comprising:

an inflated transparent sphere containing an outer surface, an inner surface, and a circumscribed space within the sphere; a scoring ball within the circumscribed space; a plurality of pairs of handles fixedly attached to the outer surface; and sacs positioned between the handles of each pair of handles, which sacs are so sized as to be able to contain the scoring ball.

2. The device of claim 1 wherein there are two pairs of handles.

* * * * *